US011585602B2

(12) United States Patent
Peel et al.

(10) Patent No.: US 11,585,602 B2
(45) Date of Patent: Feb. 21, 2023

(54) APPARATUS FOR STIRRING AND METHODS OF STIRRING

(71) Applicant: Altek Europe Ltd., Chesterfield (GB)

(72) Inventors: Alan Peel, Chesterfield (GB); Stephen Makepeace, Chesterfield (GB)

(73) Assignee: ALTEK EUROPE LIMITED, Chesterfield (GB)

( * ) Notice: Subject to any disclaimer, the term of this patent is extended or adjusted under 35 U.S.C. 154(b) by 525 days.

(21) Appl. No.: 16/462,015

(22) PCT Filed: Nov. 20, 2017

(86) PCT No.: PCT/GB2017/053483
§ 371 (c)(1),
(2) Date: May 17, 2019

(87) PCT Pub. No.: WO2018/091924
PCT Pub. Date: May 24, 2018

(65) Prior Publication Data

US 2019/0301803 A1 Oct. 3, 2019

(30) Foreign Application Priority Data

Nov. 20, 2016 (GB) ..... 1619598

(51) Int. Cl.
*F27D 27/00* (2010.01)
*H05B 6/34* (2006.01)
(Continued)

(52) U.S. Cl.
CPC ..... *F27D 27/00* (2013.01); *C21D 9/0018* (2013.01); *H05B 6/34* (2013.01); *F27D 2003/0054* (2013.01); *F27D 2003/0083* (2013.01)

(58) Field of Classification Search
CPC ..... C21D 9/0018; F27D 2003/0054; F27D 2003/0083; F27D 27/00; H05B 6/34;
(Continued)

(56) References Cited

U.S. PATENT DOCUMENTS 3,826,646 A * 7/1974 Karlsson et al. ..... C21C 5/5241 75/10.4
4,834,168 A * 5/1989 Nove ..... B22D 11/122 164/504
(Continued)

FOREIGN PATENT DOCUMENTS

CN 202254908 U 5/2012
CN 202547428 U 11/2012
(Continued)

OTHER PUBLICATIONS

International Search Report and Written Opinion from counterpart International Patent Application No. PCT/GB2017/053483 dated Mar. 1, 2018, 10 pages.

*Primary Examiner* — Scott R Kastler
*Assistant Examiner* — Michael Aboagye
(74) *Attorney, Agent, or Firm* — Norton Rose Fulbright US LLP

(57) ABSTRACT

A method of stirring and apparatus for stirring are provided. The method includes: a) providing a number of electromagnetic stirrer units, each stirrer unit being moveably mounted on a stirrer support carriage; b) providing a number of locations at which stirring is to be provided by a stirrer unit; c) providing stirring at a first location from amongst the number of locations using a stirrer unit; d) providing stirring at a second location from amongst the number of locations using the same stirrer unit, the second location being different to the first location; and wherein the stirrer unit has a first position relative to the stirrer support carriage during movement between the first location and the second location
(Continued)

and the stirrer unit has a second position relative to the stirrer support carriage at the first location and at the second location during stirring.

18 Claims, 7 Drawing Sheets

(51) Int. Cl.
*C21D 9/00* (2006.01)
*F27D 3/00* (2006.01)

(58) Field of Classification Search
CPC ..... C22C 1/026; C22C 49/14; B22D 1/00; C22B 9/05; C22B 21/064; C21C 7/072
USPC ..... 266/233, 44, 234, 237; 75/10.4, 10.16, 75/10.67, 10.65, 10.64; 373/85, 146
See application file for complete search history.

(56) References Cited

U.S. PATENT DOCUMENTS

| | | | | | |
|---|---|---|---|---|---|
| 4,940,214 | A * | 7/1990 | Gillespie | C21C 7/0068 266/235 |
| 9,550,232 | B2 * | 1/2017 | De Monte | B22D 11/122 |
| 11,002,485 | B2 * | 5/2021 | Peel | F27D 27/00 |
| 2009/0020925 | A1 | 1/2009 | Takahashi | |

FOREIGN PATENT DOCUMENTS

| | | | | |
|---|---|---|---|---|
| WO | 2015056032 | A1 | 4/2015 | |
| WO | WO2015056032 | * | 4/2015 | F27D 27/00 |

* cited by examiner

APPARATUS FOR STIRRING AND METHODS OF STIRRING

FIELD OF INVENTION

This invention concerns improvements in and relating to apparatus for stirring and methods of stirring using electromagnetic stirring and stirrers.

BACKGROUND

Electromagnetic stirrers are frequently used to stir molten metals in furnaces and other vessels. Hence they can encounter high heat levels are a result of their operating environment and, to varying extents, as a result of their own operation.

Existing approaches using such stirrers generally use a single stirrer for a single location at which stirring is to be provided.

SUMMARY

The present invention has amongst its potential aims to provide for stirring at multiple locations using a single stirrer in a manner which is suitable for implementation at a wide variety of metal processing plant.

According to a first aspect, the invention provides a method of stirring, the method including:

a) providing a number of electromagnetic stirrer units, each stirrer unit being moveably mounted on a stirrer support carriage;

b) providing a number of locations at which stirring is to be provided by a stirrer unit;

c) providing stirring at a first location from amongst the number of locations using a stirrer unit;

d) providing stirring at a second location from amongst the number of locations using the same stirrer unit, the second location being different to the first location; and wherein the stirrer unit has a first position relative to the stirrer support carriage during movement between the first location and the second location and the stirrer unit has a second position relative to the stirrer support carriage at the first location and at the second location during stirring.

According to a second aspect, the invention pro-vides apparatus for stirring, the apparatus including:

a) a number of electromagnetic stirrer units;

b) a stirrer support carriage which provides a moveable mounting for each stirrer unit;

b) a number of locations at which stirring is to be provided by a stirrer unit; wherein, the apparatus has a first state in which a stirring unit is at a first location selected from amongst the number of locations; and the apparatus has a second state in which the same stirring unit is at a second location selected from amongst the number of locations, the second location being different to the first location; and wherein the stirrer unit has a first position relative to the stirrer support carriage during movement between the first location and the second location and the stirrer unit has a second position relative to the stirrer support carriage at the first location and at the second location during stirring.

The first and/or second aspects of the invention may include any of the features, options and possibilities set out elsewhere in this document, including from amongst the following.

Preferably the stirrer unit has a first position which is a transit position. Preferably the first position is used during movement of the stirrer unit from the first location to the second location and ideally when moving between all locations. The stirrer unit may not provide stirring when in the first position.

Preferably the stirrer unit has a second position which is a use position. Preferably the second position is not used during movement of the stirrer unit from the first location to the second location and ideally is not used when moving between any location. The stirrer unit may provide stirring when in the second position.

The stirrer unit may be closer to the carriage when in the first position compared with when in the second position. The first position may be a retracted position. The second position may be an extended position.

The transition from the first position to the second position may be perpendicular to the transition from the first location to the second location. The transition is preferably in a horizontal plane.

The apparatus may include one or more stirrer support elements. Preferably one or more stirrer support elements are provided at the first location and/or second location and/or further locations. Preferably a pair of stirrer support elements are provided at each location. The stirrer support element(s) are preferably fixed in place at their location. Preferably the stirrer support element(s) do not move during the movement of the stirrer unit between the first location and the second location. Preferably the stirrer support element(s) do not move during the movement of the stirrer unit between the first position and the second position.

In a first embodiment in particular, the support element(s) may be rail(s). A pair of parallel rails is preferred.

In a second embodiment, the support elements may be wheels. One or more pairs of wheels in a fixed orientation may be preferred. Preferably they cooperate with a pair of support elements, such as rails.

The stirrer support carriage may include one or more support components for the stirrer unit, the one or more support components allowing relatively movement between the stirrer unit and the stirrer support carriage. Preferably the movement in the relative movement is made by the stirrer unit. Preferably the stirrer support carriage is stationary during the relative movement.

In a first preferred embodiment, the one or more support components may support one or more wheels pro-vided on the stirrer unit. The one or more support compo-nents may be one or more rails. The one or more wheels may each have a flange, preferably on the inside. More preferably the one or more wheels may each have a flange on the inside and outside of the wheel. The wheels on the stirrer unit may provide for relative movement between the stirrer unit and a stirrer support component.

In a second embodiment, the one or more support components may be wheels. The one or more wheels may each have a flange, preferably on the inside. More preferably the one or more wheels may each have a flange on the inside and outside of the wheel. One or more pairs of wheels in a fixed orientation may be preferred. Preferably they cooper-ate with a pair of support components, such as rails.

The first and/or second preferred embodiment may include a centralising wheel, for instance to adjust and/or control the position of the stirrer relative to the stirrer support carriage and/or relative to the one or more support components.

When the stirrer support carriage is at the first location, a stirrer support component provided on the stirrer support carriage is preferably aligned with a stirrer support element provided separately from the stirrer support car-riage. Preferably each stirrer support component is so aligned.

When the stirrer support carriage is at the second location and/or one or more further locations, a stirrer support component provided on the stirrer support carriage is preferably aligned with a stirrer support element provided separately from the stirrer support carriage. Preferably each stirrer support component is so aligned.

Preferably one end of the stirrer support element is provided proximal to the stirrer support component when the stirrer support carriage is in the first location. Preferably the stirrer support element and the stirrer support component provide a substantially continuous support for the stirrer unit when the stirrer support carriage is in the first location. Preferably corresponding positioning is provided at the second location and/or further locations.

Preferably during the transition from the first position to the second position, at least a part of the weight of the stirrer unit is transferred from the stirrer carriage support to the one or more support elements. Preferably during the transition from the second position to the first position, all of the weight of the stirrer unit is removed from the one or more support elements and/or is returned to the one or more support elements.

Preferably the transition from the first position to the second position and/or the transition from the second position to the first position is controlled. For instance, one or more position sensors may be provided and the feedback from the one or more sensors may be used to control the transition. The one or more sensors may include one or more sensors which sense the position of the stirrer relative to the stirrer support carriage and/or relative to the location and/or relative to the furnace at a location.

The stirrer unit may have the same vertical plane position in the first position and in the second position. The stirrer unit may have the same vertical plane position during the transition from the first position to the second position and/or during the transition from the second position to the first position.

In an embodiment, the stirrer unit may have a different vertical plane position in the first position and in the second position. The stirrer unit may be lifted in the vertical plane before any movement toward the second position in the horizontal plane. The stirrer may have the same vertical plane position during the transition and/or horizontal plane transition from the first position to the second position. The stirrer may have the same vertical plane position during the transition and/or horizontal plane transition from the second position to the first position. The stirrer unit may be lowered in the vertical plane after any movement toward the first position in the horizontal plane.

The stirrer unit may be lifted relative to the stirrer support carriage. The stirrer unit may be lifted by a hydraulic system. The stirrer unit may be lifted by a scissor lift system and/or screw jack system, for instance electric powered systems.

The stirrer unit may have a different vertical plane position in the second position at a first location compared with when in the second position at a second location and/or one or more further locations. One or more of the different vertical plane positions may be higher or lower when compared with one or more of the other different vertical plane positions. The one or more locations may each be provided with a furnace, the depth of the furnace and/or the vertical position of the furnace being different at one or more of the locations from the furnace in at least one of the locations.

The stirrer unit may be moved from a first location to a second location in the Z axis. The stirrer unit may be moved at the second location from a first height position to a higher second height position in the Y axis. The stirrer unit may then be moved at the second location towards the second position in the X axis. Particularly after stirring at a second location is completed, the stirrer unit may be moved at the second location towards the first position in the X axis. The stirrer unit may be moved at the second location from a second height position to a lower first height position in the Y axis. The stirrer unit may then be moved from the second location to a first location or another location in the Z axis.

The stirrer unit may have the same axial position, along the axis of movement from the first location to the second location, in the first position and in the second position. The stirrer unit may have the same axial position during the transition from the first position to the second position and/or during the transition from the second position to the first position.

The stirrer unit may have a different axial position, perpendicular to the axis of movement from the first location to the second location in a horizontal plane, in the first position and in the second position. The stirrer unit may have the same vertical plane position during the transition from the first position to the second position and/or during the transition from the second position to the first position.

A stirrer unit may be provided alongside the first location at a first time and may be moved to be alongside the second location at a second different time. The stirrer unit may be provided alongside a further location at a further different time. The stirrer unit may be returned to be along-side the first location again at a still further different time. [0041] The position of the stirrer unit relative to a location, including the first location and/or second location and/or one or more further locations, may be controlled. For instance, one or more limit switches may be used to detect the position of the stirrer unit and/or stop further movement of the stirrer unit at a location.

The position of the stirrer unit at a location, including the first location and/or second location and/or one or more further locations, may be fixed by a releasable engagement, for instance between an element on the stirrer unit and an element fixed at the location. The releasable engagement may be a pin and slot engagement. The engagement may be released when the stirrer unit is to be moved from a location to a different location.

The stirrer unit may be rotationally mounted on the stirrer support carriage. The stirrer unit may be rotatable through at least 90°, more preferably at least 180°. Prefer-ably rotation in a first direction is followed by counter rotation, rather than further rotation.

The stirrer unit may be provided at a first location with a first rotational orientation. The stirrer unit may be provided at a second location with a second rotational orientation. The stirrer unit may be provided at one or more further locations with one or more further rotational orientations. The first rotational orientation and/or second rotational orientation and/or one or more further rotational orientations may include two or more different orientations. The two or more different orientations may differ from one another by 90°+/−5° or by 180°+/−5°.

The stirrer unit may be rotated between a rotational orientation and a different rotational orientation at a location provided with molten metal for stirring and/or at one or more intermediate locations with no molten metal for stirring present. An intermediate location may be used where the physical constraints at a location prevent successful rotation of the stirrer unit from a rotational orientation to a different rotational orientation.

The stirrer unit may be provided at a first rotational orientation at a first location. The stirrer unit may then be moved from the first location to a second location. The stirrer unit may then be rotated from the first rotational orientation to a second rotational orientation at the second location.

The stirrer unit may be provided at a first rotational orientation at a first location. The stirrer unit may then be rotated from the first rotational orientation to a second rotational orientation at the first location. The stirrer unit may then be moved from the first location to a second location.

The stirrer unit may be provided at a first rotational orientation at a first location. The stirrer unit may then be moved from the first location to an intermediate location. The stirrer unit may then be rotated from the first rotational orientation to a second rotational orientation at the intermediate location. The stirrer unit may then be moved from the intermediate location to a second location.

The stirrer unit is preferably rotated with the stirrer unit in the transit position.

An embodiment may be provided in which the stirrer unit is capable of X axis and rotational movement only, or, X and Y axis and rotational movement only, or, is incapable of Z axis movement.

According to a third aspect of the invention there is provided a method of stirring, the method including:

a) providing an electromagnetic stirrer unit, the stirrer unit being moveably mounted on a stirrer sup-port carriage;

b) providing the stirrer unit at a first location and stirring molten metal using the stirring unit whilst at the first location; and wherein the stirrer unit has a first vertical position relative to the stirrer support carriage during a first part of the stirring at the first location and a second different vertical position relative to the stirrer support carriage during a second part of the stirring at the first location.

The third aspect of the invention may further include:

a) providing a number of electromagnetic stirrer units, each stirrer unit being moveably mounted on a stirrer support carriage;

b) providing a number of locations at which stirring is to be provided by a stirrer unit;

c) providing stirring at a second location from amongst the number of locations using the same stirrer unit, the second location being different to the first location; and wherein the stirrer unit has a first position relative to the stirrer support carriage during movement between the first location and the second location and the stirrer unit has a second position relative to the stirrer support carriage at the first location and at the second location during stirring.

According to a fourth aspect of the invention there is provided apparatus for stirring, the apparatus including:

a) an electromagnetic stirrer unit, the stirrer unit being moveably mounted on a stirrer support carriage;

wherein the apparatus has a first state in which the stirrer unit is at a first location;

wherein, in the first state, when in use, the stirrer unit stirs molten metal;

wherein, in the first state, the stirrer unit has a first vertical position relative to the stirrer support carriage during a first part of the stirring at the first location and a second different vertical position relative to the stirrer support carriage during a second part of the stirring at the first location.

The fourth aspect of the invention may further include:

a) a number of electromagnetic stirrer units;

b) a number of locations at which stirring is to be provided by a stirrer unit; wherein, the apparatus has a first state in which a stirring unit is at a first location selected from amongst the number of locations; and the apparatus has a second state in which the same stirring unit is at a second location selected from amongst the number of locations, the second location being different to the first location; and wherein the stirrer unit has a first position relative to the stirrer support carriage during movement between the first location and the second location and the stirrer unit has a second position relative to the stirrer support carriage at the first location and at the second location during stirring.

The third and/or fourth aspects of the invention may include any of the features, options and possibilities set out elsewhere in this document, including from amongst the following:

The first vertical position may be lower than the second vertical position. The first vertical position may align the stirrer unit with a lower section of a furnace. The first vertical position may align the stirrer unit with the bottom section of a furnace.

The first vertical position may be selected during initial charging of a furnace.

The first vertical position may be selected at the end or towards the end of discharging from a furnace.

The second vertical position may be higher than the first vertical position. The second vertical position may align the stirrer unit with an upper section of a furnace. The second vertical position may align the stirrer unit with the mid-section of a furnace.

The second vertical position may be selected after initial charging of a furnace.

The second vertical position may be selected prior to the end of discharging from a furnace.

The second vertical position may be selected when the furnace is over ¼th full or over half full and/or over ⅔rds full and/or full.

The transition between the first vertical position and the second vertical position may be conducted in a single discrete step. The transition between the first vertical position and the second vertical position may be conducted in a series of discrete steps, for instance more than 2 steps or more than 3 steps or more than 5 steps. The transition between the first vertical position and the second vertical position may be conducted in a continuous movement.

The upward and/or downward movement of the stirrer unit may be controlled. The movement may be controlled using a pre-determined sequence of movements. The movement may be controlled using feedback from one or more sensors, for instance indicative of metal depth and/or the extent of the filling of the furnace.

The stirrer unit may have a lowered vertical position. The stirrer unit is preferably in the lowered vertical position during movement between the first location and the second location and/or one or more further locations.

The stirrer unit may be moved up and down relative to the furnace in the extended use position. The stirrer unit may provide stirring during vertical movement of the stirrer unit.

The stirrer unit may be provided in a first use height position, where the stirrer unit is used to stir at that first height position. The stirrer unit may then be retracted to the transit position, preferably prior to returning to the extended use position, but at a different second use height position. Preferably the stirrer unit is once again used to stir at that second height position.

The further features, options and possibilities for the first and/or second and/or third and/or fourth aspects of the invention include those taken from amongst the following:

The method of stirring may be a method of stirring molten metal. The method of stirring may be a method of stirring aluminium. The method of stirring may be a method of stirring a furnace. The method of stirring may be a method of stirring a ladle, storage vessel, transport vessel, holding furnace. The method may be a method of electromagnetic stirring.

The method of stirring may be a method of stirring using a side mounted stirrer.

The stirrer units may be provided alongside a location at which stirring is to be provided, and preferably alongside all the locations at which stirring is to be provided. A stirrer unit may only be provided alongside one location at a time.

The number of stirrer units may be 1. The number of stirrers may be more than 1.

A stirrer unit may include one or more of: one or more electromagnetic coils; an housing; a support frame for one or more electromagnetic coils; one or more cooling spaces for instance within a housing.

A stirrer unit may be moveably mounted, prefer-ably by being mounted, on a carriage. The carriage may be provided with wheels. The carriage may move on a continuous surface, for instance a floor. The carriage may move on a limited surface, such as a rail or rails. All the stirrers may be so provided. The carriage may provide the capacity to move the stirrer unit from the first location to the second location.

One or more conduits may be provided to provide fluid communication for a coolant, such as air, to the stirrer unit, particularly a housing thereof. One or more conduits may be provided to provide fluid communication for a coolant, such as air, away from the stirrer unit, particularly way from a housing thereof. One or more conduits may be provided on the carriage.

The stirrer unit(s) may be moveably mounted to allow for travel between a first location and a second location, where the second location is at least 2 metres, potentially at least 5 metres from the first location, prefer-ably at least 10 metres from the first location and more preferably at least 20 metres from the first location.

The number of locations may be more than 2.

Preferably the number of locations at which stirring is to be provided exceeds the number of stirrer units by at least 1.

The first location may be a location adjacent to a first container of molten metal, for instance a first furnace. The first location may be adjacent to the first container by being to the side of the first container or alongside the container.

The second location may be a location adjacent to a second container of molten metal, for instance a second furnace. The second location may be adjacent to the second container by being to the side of the second container or alongside the container.

One or more further locations may be provided, with those locations adjacent to further containers of molten metal, for instance further furnaces. The further locations may be adjacent to the further containers by being to the side of the further containers or alongside the containers.

The first location may be separated from the second location by at least 2 metres, potentially at least 5 metres, preferably at least 10 metres and more preferably at least 20 metres. Two or more of the locations, and potentially all of the locations, may be separated from each other by at least 5 metres, preferably at least 10 metres and more preferably at least 20 metres.

The stirrer unit is preferably in fluid communication with a source of coolant, such as air, when at the first location. The stirrer unit is preferably in fluid communication with a source of coolant, such as air, when at the second location. The stirrer unit is preferably in fluid communication with a source of coolant, such as air, when at each of the locations at which stirring is to be provided. Preferably the source of coolant to the first and second, and preferably each, location is the same, such as a common pump or fan.

BRIEF DESCRIPTION OF THE DRAWINGS

Various embodiments of the invention will now be described, by way of example only, and with reference to the accompanying drawings in which.

DETAILED DESCRIPTION

Electromagnetic stirrers are known for stirring the molten metal contents of a variety of vessel types, including furnaces, holding vessels, ladles etc. The electromagnetic stirrers are positioned adjacent the vessel and hence are operating in a hot environment and generate internal heat during operation. For this reason, they are often actively cooled, with air being a preferred coolant.

Electromagnetic stirrers are expensive pieces of equipment and are not in full time operation for any one vessel as they are not needed during parts of the molten metal handling cycle.

The applicant has proposed in WO2015/056032 a stirring system and stirring method whose approach allows a single electromagnetic stirrer to be used at a number of different stirring locations, whilst conveniently providing cooling at those stirring locations.

Figure 1:
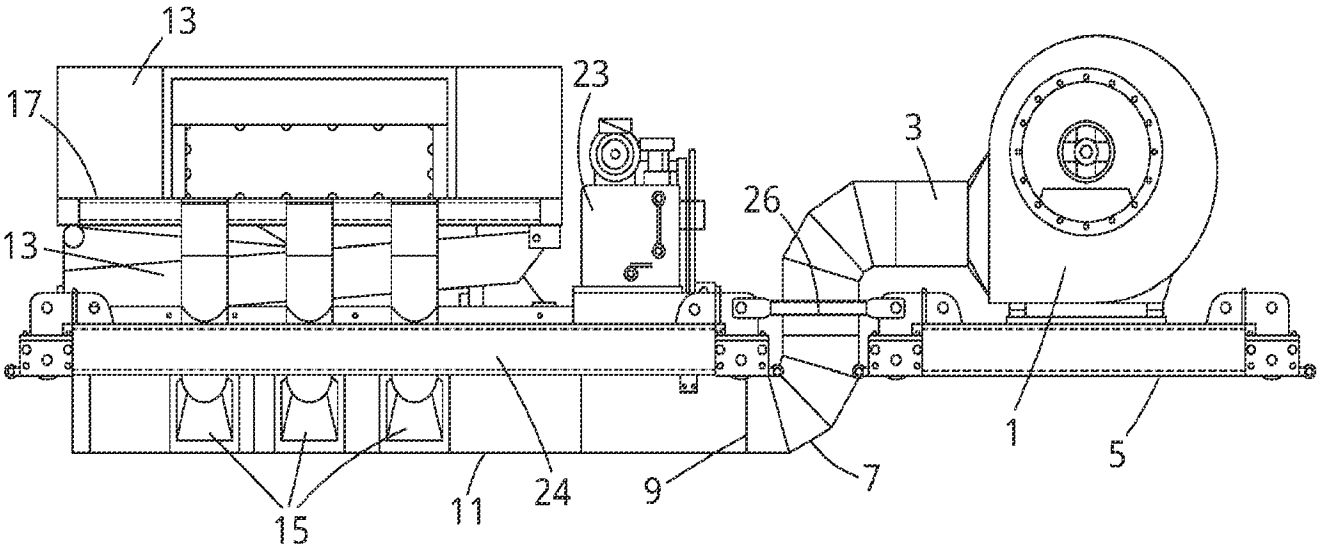
Fig. 1 Prior Art
FIG. 1 is a side view of a prior art stirring system in one position.

Referring to FIG. 1, which illustrates the system of WO2015/056032, a centrifugal pump or fan 1 for the coolant, in this case air, is provided. The pump 1 draws in air from the environment of the pump 1 and supplies it to an outlet 3. The pump 1 is provided at a first floor level 5 and the outlet 3 conveys the air down to a lower level 7. The outlet 3 ends at an interface 9.

As shown, the interface 9 provides fluid communication between the outlet 3 and the stirrer supply conduit 11. The stirrer supply conduit 11 carries the coolant under the stirrer 13 to three stirrer inlets 15. Each stirrer inlet 15 conveys coolant up into the stirrer 13. Suitable baffles or the like (not shown) are provided to ensure consistent coolant delivery to each stirrer inlet 15. The stirrer inlets 15 convey the coolant into the housing 17 of the stirrer 13 where heat transfer to the coolant provides the necessary cooling effect under the control of suitable internal designs, including baffles and the like.

The heated coolant exits the housing 17 to the environment, but other embodiments are possible in which the heated coolant returns down stirrer outlet (directly behind the inlets in the illustration) and hence into the stirrer supply conduit 11 from where the coolant flows away, to the left-hand side as shown and then out to atmosphere.

In this way the necessary cooling is provided.

As shown in FIG. 1, the stirrer 13 is in the retracted, inactive position. Hydraulics 23 and suitable support arms 21, potentially as a scissor lift, provide the motion to lift the stirrer 13 up and away from the carriage 24 it rests upon. A screw jack system is also provided in a further embodiment. In the elevated position, the stirrer 13 is closer to the furnace (not shown) and so is better able to provide the active stirring position. As the stirrer 13 is lifted, flexible sections of the stirrer inlets 15 allow the required motion. Concertina or bellowed sections or the like can be used for this purpose. Mechanical and other forms of mechanism may be used to provide the motion to the stirrer 13.

The support carriage 24 allows the stirrer 13 to be moved from one location to another location where stirring is required. This allows a single stirrer 13 to be used at multiple locations, rather than have the capital cost of a stirrer 13 at leach of those locations.

At each stirring location the stirrer 13 is provided with air cooling. As described above, this is through connection to a pump or fan 1, and the outlet 3 therefrom. That connection could be made when the stirrer 13 is present at the stirring location and then be broken when the stirrer 13 is moved away from that location. Such a situation would occur if the fan 1 in FIG. 1 was fixed in position, but the stirrer 13 on its carriage 24 was moveable relative to the fan 1; a situation described in more detail below in relation to the FIG. 2, FIG. 3*a* and FIG. 3*b* embodiments.

Alternatively, and as illustrated in FIG. 1, the fan 1 can itself be mounted on a fan carriage 26 which is also adapted for movement and which is connected to the carriage 24 on which the stirrer 13 is provided by a link 28. The link 28 means that as the carriage 24 and its stirrer 13 are moved then the fan carriage 26 and its fan 1 move too. This maintains the connection between the outlet 3 from the fan 1, via the interface 9 to the stirrer supply conduit 11, and allows the air to pass to the stirrer 13.

Of course, the link 28 also means that as the fan carriage 26 and its fan 1 are moved then the carriage 24 and its stirrer 13 move too. In a further alternative, not illustrated, the fan 1 can be mounted on the same carriage 24 as the stirrer 13, so that the two move about together.

Figure 2:
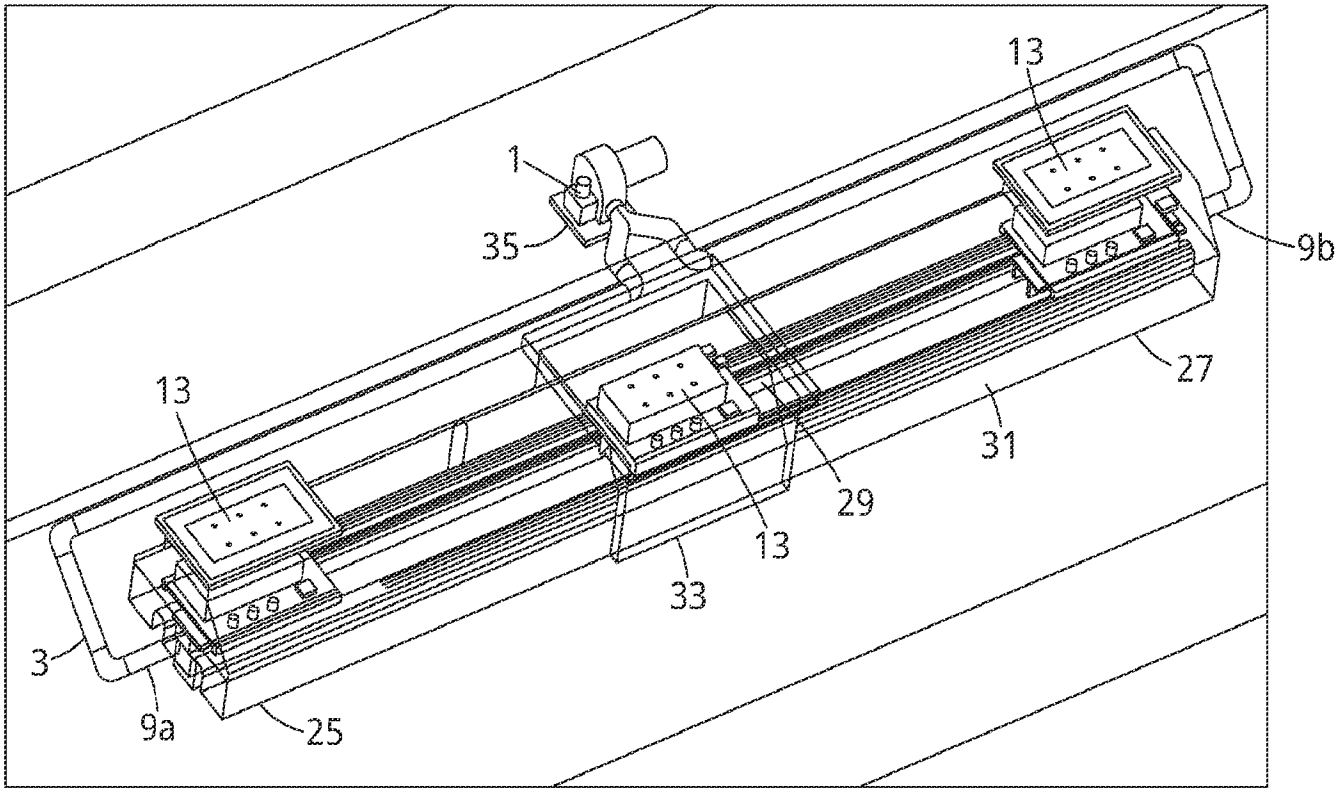
Fig. 2 Prior Art
FIG. 2 is a perspective view of a prior art stirring system.

In FIG. 2, the general principle outlined in FIG. 1 has been extended to show the use of a single stirrer 13 to provide an active stirring position at a first location 25 and a second location 27. The first location 25 is linked to the second location 27 by means of a channel 29 in the foundations 31 of the plant site. In this case, a linear channel 29 is shown but other channel shapes are possible which accommodate the stirrer 13 and its support carriage 24.

An intermediate position 33 is also provided part way along the channel 29 which allows for easy access to the stirrer 13, hydraulics 19 (or electric screw jack system), support arms 21 and carriage 24 for maintenance purposes.

For illustrative purposes the stirrer 13 is shown at all three locations, but in reality only one stirrer 13 is provided in the channel 29.

The single cooling fan 1 at position 35 provides coolant to the outlet 3 as before. In this embodiment, the fan 1 is in a fixed position on the foundations 31. The fan 1 does not move; otherwise the manner of connection is very similar to the FIG. 1 embodiment.

The outlet 3 extends the full length of the channel 29 and goes down into the channel 29 at each end to provide an interface 9*a* for the first location 25 and an interface 9*b* for the second location 27. In alternative embodiments (not illustrated), the outlet 3 can connect to ducting provided to the side or more often above the process equipment.

In use, when stirring is desired at the first location 25, the stirrer 13 is moved on its carriage 24 along the channel 29 until it is at the first location 25. The movement to the first location 25 connects the stirrer supply conduit 11 to the outlet 3 via the interface 9*a*. With the stirrer 13 at the first location 25, the stirrer 13 can be elevated and the stirring performed for the requisite time. The stirrer 13 can then be taken to the retracted, inactive position, and can then be moved along the channel 29 to the second location 27 to provide stirring there. Again the movement to the second location 27 provides the connection of the outlet 3 via the interface 9*b* to the stirrer supply conduit 11.

As mentioned above, the number of locations at which stirring can be provided can be increased by stopping the stirrer 13 at other locations and/or by providing other channel or rail configurations.

The operation of the interface 9 for providing cooling air to the stirrer 13 is shown in more detail in WO2015/056032.

Whilst the above mentioned approach is suitable for stirrers 13 provided under a furnace or the like by means of channel 29 in the foundations 31, there are beneficial modifications to be made in implementing the system for side stirring of a furnace or the like.

Figure 3:
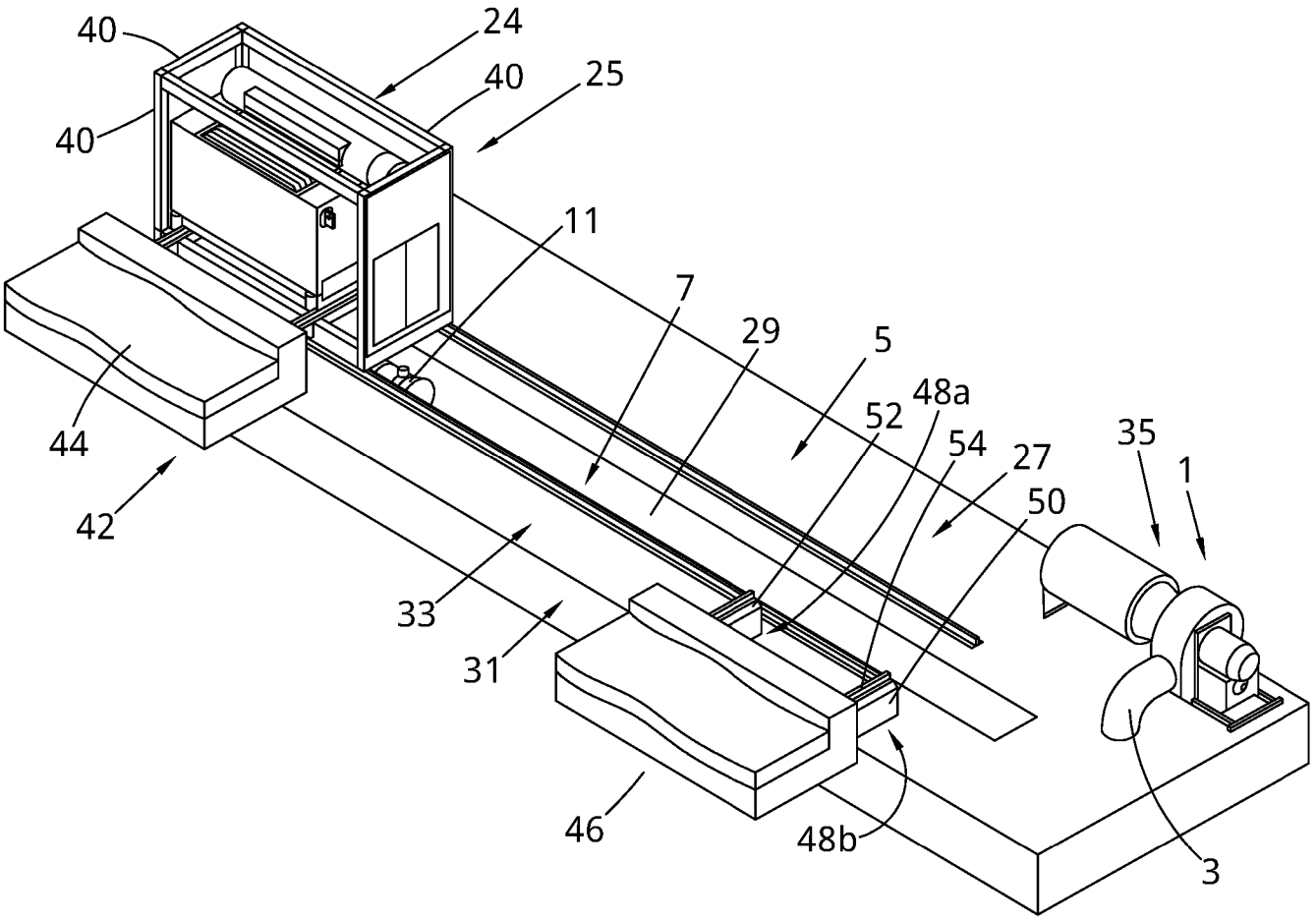
FIG. 3 shows an embodiment of the invention with the stirrer in the transit position at a first location.

As seen in FIG. 3, the stirrer 13 is mounted within a support frame 40 which is mounted on the stirrer support carriage 24. The stirrer support carriage 24 provides the cooling system for the stirrer 13. The cooling system is again an air cooling system and is provided by the connection type described in WO2015/056032 by means of the interface 9 at the lower level 7. The centrifugal pump or fan 1, provided at first floor level 5, is provided again with an outlet 3 which connects to the conduits for the air cooling which lead to interface 9. The air cooling system could be connected at other levels and can be supplied by ducting to the side or above the process equipment, as desired.

As shown in FIG. 3, the stirrer 13 is at the first location 25 and is in the transit position. The transit position references a stirrer 13 state in which it is not intended to be providing stirring forces to the location to be stirred. In this example, the location to be stirred is a first furnace 42 and more particularly the molten metal 44 within the first furnace 42. In the transit position the stirrer 13 is retracted and is within the support frame 40 provided on the stirrer support carriage 24. The stirrer 13 will generally be off in this state.

In the FIG. 3 embodiment, the stirrer 13 can be considered to have finished the stirring operation at the first location on the molten metal 44 in the first furnace 42. The next designated task for the stirrer 13 is the stirring of molten metal 44 in a second furnace 46 at a second location 27.

The second location 27 includes a pair of stirrer supports 48*a*, 48*b*. The stirrer supports 48*a*, 48*b* are formed of a first floor contacting element 50 in each case. The element 50 may be of reinforced concrete. The element 50 provides a planar surface 52 upon which a rail 54 is mounted. The rail 54 has a first end 56 proximal the second furnace 46 and a second end 58 distal the second furnace 46.

Figure 4:
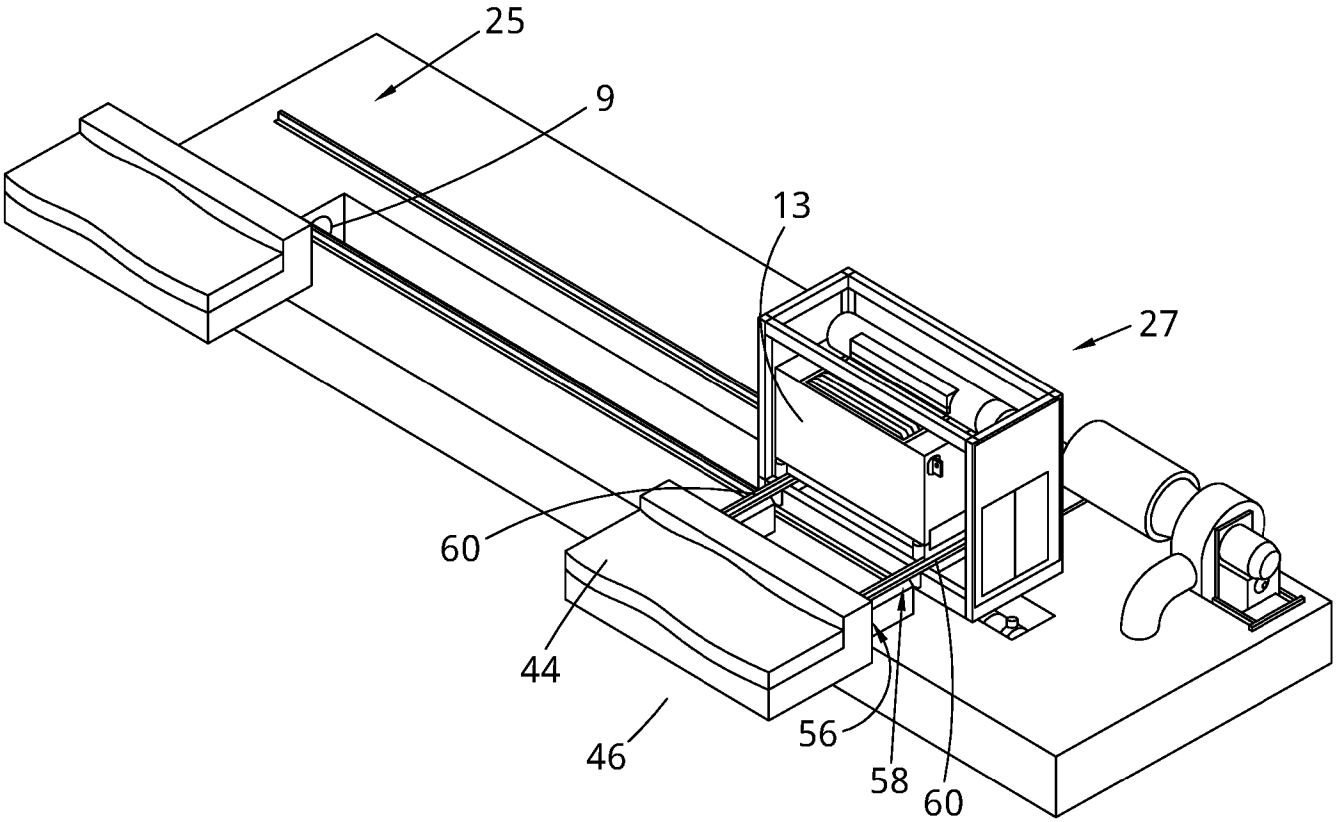
FIG. 4 shows the embodiment of FIG. 3 in the transit position at a second location.

As shown in FIG. 4, the stirrer 13 on the stirrer support carriage 24 has been moved from the first location 25 to the second location 27. The stirrer 13 is still in the transit position at the second location 27.

The stirrer support carriage 24 has a pair of later-ally aligned carriage mounted rails 60 upon which the stirrer 13 is supported. Each carriage mounted rail 60 has a projecting end 62 which is distal the stirrer support carriage 24.

In the second location, carriage mounted rails 60 are aligned with the rails 54 on the elements 50. The carriage mounted rails 60 and the rails 54 are aligned longitudinally along the channel 29, the X-axis, and vertically, the Y-axis. The second end 58 of each rail 54 is close to the projecting end 62 of the carriage mounted rails 60. The gap is preferably less than 2 cm.

Just as in the first location 25, in the second location 27 cooling air can be provided to the stirrer 13 through the interface 9.

The stirrer 13 arrives in the second location 27 in the transit position. Limit switches (not shown) are used to stop the movement when the stirrer 13 arrives at a second location 27 or other location. Once at the second location 27 or other location, further inadvertent movement of the stirrer support carriage 24 in that direction or the return direction is prevented by a locating pin (not shown) which cooperates with the stirrer support carriage 24 and an immobile fixing location, for instance a part of the foundations. The locating pin is removed when movement of the stirrer support carriage 2 4 to another location is required.

Figure 5:
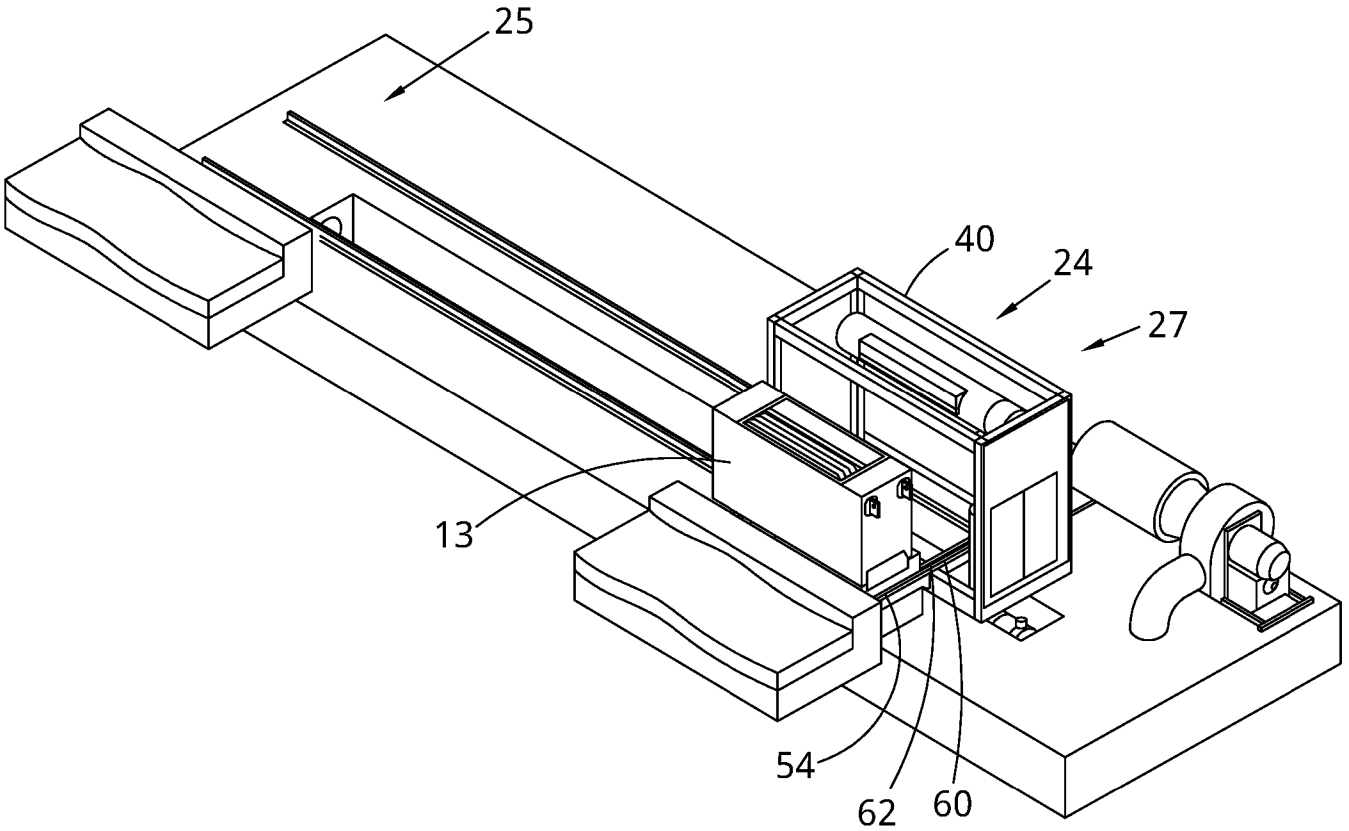
FIG. 5 shows the embodiment of FIGS. 3 and 4 in the use position at the second location.

When it is desired to use the stirrer 13, then the controls (not shown) for the stirrer 13 are used move the stirrer 13 from the transit position to the use position. The use position is illustrated in FIG. 5 with respect to the stirrer 13 at the second location 27. The movement from the transit position to the use position is achieved by applying a lateral force to the stirrer 13. The stirrer 13 moves along the carriage mounted rails 60 on wheels 64 at the bottom of the stirrer 13. The wheels 64 cross from the carriage mounted rails 60 to the rails 54 on the element 50 as the movement progresses. The controls cause the stirrer 13 to advance until it reaches the desired use position relative to the second furnace 46, stainless steel plates mounted on the side of the second furnace 46 and the molten metal 44 within. The advance of the stirrer 13 to the desired use position and the return of the stirrer 13 to the transit position on the stirrer support carriage 24 is controlled by position sensors.

The wheels are provided with peripheral flanges on both edges so as to accurately retain the position of the wheels 64 and hence the stirrer 13. The remaining movement possible due to the necessary tolerance between the flanges and the rails 60 does not result in an inaccurate position as a centralising wheel (not shown) is used to further control the position.

Once in the use position, the controls can cause the application of the necessary inputs to the stirrer 13 to give the desired mode of stirring for the molten metal 44 in the second furnace 46. The X position is optimised by the pre-determined position of the rails 54, the Y position is optimised by the predetermined by the height of the rails 54, carriage mounted rails 60 and the stirrer 13 upon them. The Z-axis position is optimised by the position that the stirrer 13 is moved to on the rails 54. The X, Y and Z position is truly optimised in that there is no play or variation in the position achieved because of the rigidity of the support system employed in the transit position, in the use position and in the transition between the two positions.

Movement of the stirrer support carriage 24 is fully inhibited, unless the stirrer 13 is in the transit position, so as to prevent accidental damage to any of the system elements.

Once the stirring operation is completed at the second location 27, then the controls turn the operating conditions off and trigger the withdrawal of the stirrer 13 from the use position to the transit position. The stirrer 13 can then be returned to the first location 25 for a stirring operation there, moved to a maintenance position or moved to one or more further stirring operation locations (not shown).

In the illustrated examples above, the first furnace 42 and the second furnace 46 are provided in the same vertical position relative to the stirrer support carriage 24 and its high relative to the foundations 31. Hence, the first furnace 42 and the second furnace 46 are stirrer successfully using a range of X and Z axis movement. However, the invention can also be modified to allow the same stirrer 13 mounted on a stirrer support carriage 24 to effectively stir furnaces which materially vary in vertical position relative to one another; provision of Y axis movement.

Figure 6:
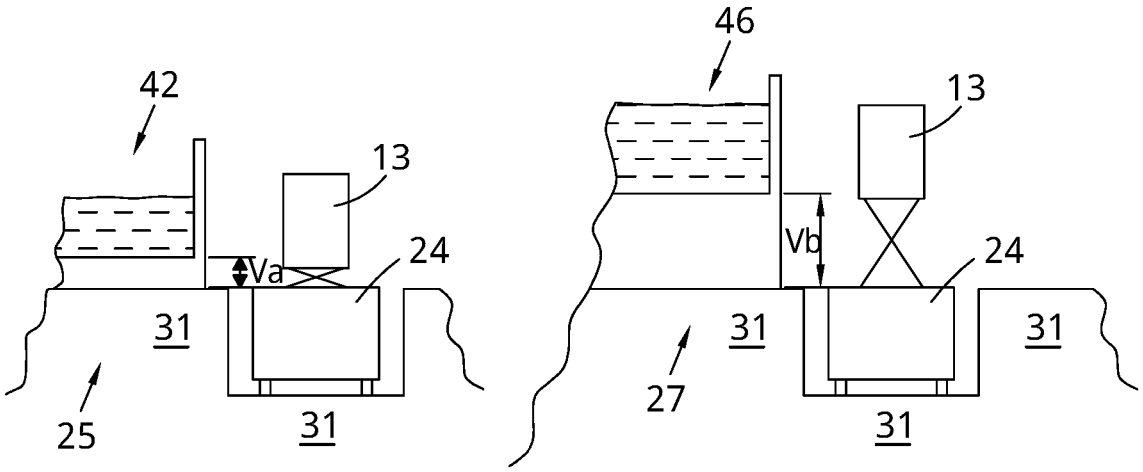
FIG. 6 shows an embodiment in which variation in the vertical position of two furnaces is accounted for by the invention.

In FIG. 6, a first furnace 42 at a first location 25 is shown at a similar vertical height Va relative to the foundations 31 and the top of the base of the stirrer support carriage 24. However, the second furnace 46 at the second location 27 is at a greater height Vb, for instance 1.5 times Va. Further furnaces at greater heights (not shown) could similarly be accommodated in a similar manner. Once the stirrer support carriage 24 has been advanced to the correct Z axis position, then the stirrer 13 can be lifted on the stirrer support carriage 24 to the correct height or Y axis position. The stirrer 13 can then be advanced towards the furnace until it reaches the correct horizontal or X axis position. A wide range of heights can be accommodated in this manner.

In a further embodiment, the stirrer support carriage 24 is modified to allow greater orientation flexibility for the stirrer 13 relative to its stirrer support carriage 24. In some instances, the ability to move the stirrer support carriage 24 along the Z axis to different locations is not enough. Different furnaces may be provided so close together that a suitable track for the stirrer support carriage 24 cannot be arranged. In a similar vein, even where a single track for the stirrer support carriage 24 is possible, the furnaces may be to different sides of that track.

Figure 7:
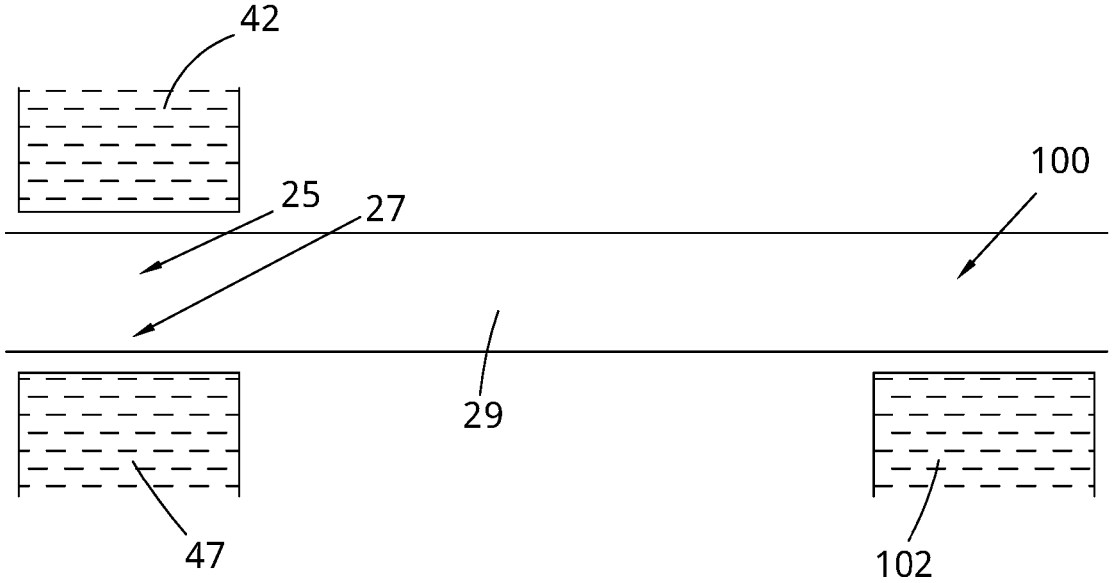
FIG. 7 shows a further embodiment of the invention, in plan view, with the stirrer and stirrer support carriage removed for illustrative purposes.

FIG. 7 is a plan view and provides a first location 25 and a first furnace 42 to one side of the channel 29 in a similar manner to that described in the previous embodiments. However, a second location 27 and its second furnace 47 is provided on the other side of the channel 29 immediately opposite the first location 25 and first furnace 42. There is insufficient space for a single track to present the stirrer 13 of the first embodiment successfully to both the first location 25 and the second location 27. FIG. 7 also shows a third location 100 with a third furnace 102 on the other side of the channel 29 to the first location 25 too.

In the modified embodiment, the stirrer 13 is mounted on the stirrer support carriage 24 in a manner which allows for at least 180° rotation of the stirrer 13 relative to the stirrer support carriage 24. Thus, after the stirrer 13 is retracted to the transit position at the first location, it is possible to rotate the stirrer 13 on the stirrer support carriage through 180° so that the stirrer is opposite the second furnace 47 at the second location 27. The stirrer 13 can then be advanced to the use position to provide stirring for the molten metal in the second furnace.

Once the stirring of the molten metal in the second furnace 47 is achieved, then the stirrer 13 can be retracted to the transit position and the stirrer support carriage can be moved along until the stirrer 13 is opposite the third location 100 and third furnace 102. The stirrer 13 can then be advanced to the use position to stirrer and so on.

In general, rotation to the original position will be provided through reverse rotation through 180° rather than continued rotation in the same direction through a further 180° so as to simplify the connection of control and power systems to the stirrer.

If the separation between the first furnace 45 and the second furnace 47 is insufficient to allow rotation of the stirrer 13 on the stirrer support carriage 24 at the first location, then the stirrer support carriage 24 may be moved on the Z axis to a sufficient extent to be clear of the first furnace 45 and the second furnace 47. Rotation of the stirrer 13 can then occur before the stirrer support carriage 24 is returned to the first furnace 45 and second furnace 47, but now facing the second furnace 47. The stirrer 13 can then be advanced to the use position to give stirring.

If the two or more furnaces of interest are accessible from a common position, such as the first furnace 45 and the second furnace 47 in opposition to one another in the previous embodiment, then the stirrer support carriage 24 may be configured to only offer X axis and rotational movement or X and Y axis and rotational movement, but without the need for Z axis movement.

Figure 8A:
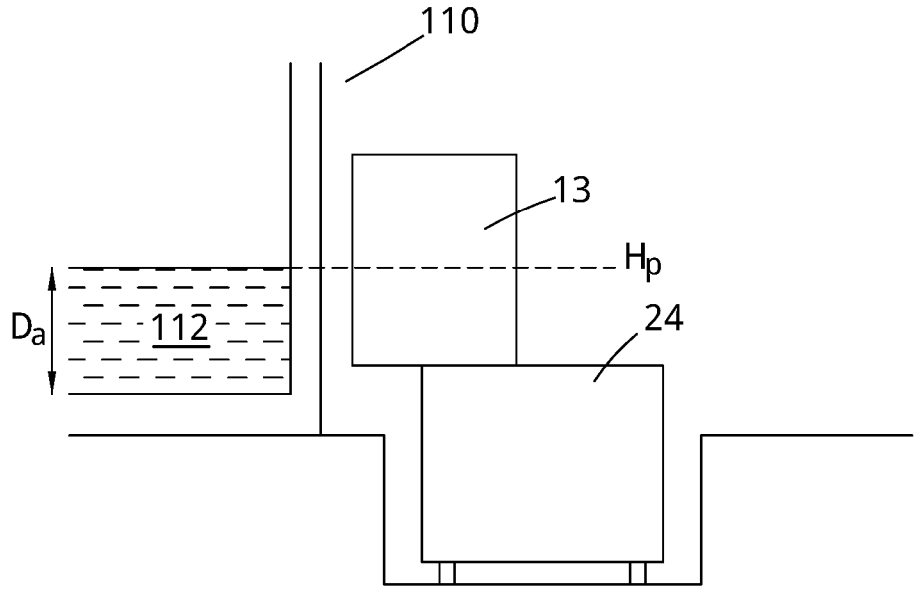
FIG. 8*a* shows the vertical position for the stirrer in use in a first operative state for the furnace.
Figure 8B:
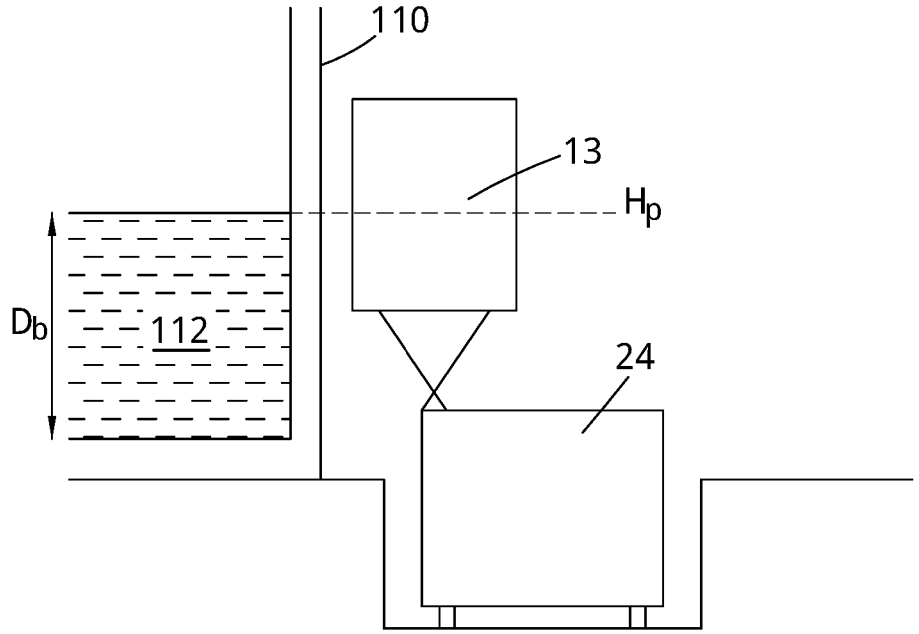
FIG. 8*b* shows the vertical position for the stirrer in use in a second operative state for the furnace.

FIG. 8*a* and FIG. 8*b* show a further embodiment in which the ability to vary the height position of the stirrer 13 relative to the furnace is desirable. In this case, the movement important to the embodiment is relative to a single furnace 110 and is in terms of the height position. The different movements described above may still apply with respect to movement between different locations also.

In FIG. 8*a*, the furnace 110 is shown during initial charging with molten metal 112. At this early time in the charging profile, the depth Da of molten metal 112 within the furnace 110 is relatively low and so it is beneficial to position the stirrer 13 such that the stirrer 13 too is relatively low and hence low down on the side of the furnace 110. This can be considered as a first height position. As shown a horizontal plane HP extending from the mid-height position relative to the height of the stirrer 13 generally corresponds with the top surface 116 of the molten metal 112 in the furnace 110.

FIG. 8*b* shows the furnace 110 with a full charge of molten metal 112. The depth of molten metal Db is now substantial. Hence, it is desirable to position the stirrer 13 at a more central position; a different, second height position. As shown the same horizontal plane HP extending from the stirrer 13 is position so as to be at around the mid depth for the molten metal 112; so the position is ½ Db.

The stirrer 13 may be moved up and down relative to the furnace 110 in the extended use position in this embodiment. In that way, stirring can be continuously provided as the molten metal depth increases from at or near zero to a full charge and/or as the molten metal is drained again to at or near empty.

Alternatively, the stirrer 13 may be provided in a first use height position, where the stirrer 13 is used to stir at that first height position, and then may be retracted to the transit position prior to returning to the extended use position, but at a different second use height position where the stirrer 13 is once again used to stir at that second height position. Multiple, sequential height positions may be employed for increasing and/or decreasing depths of molten metal 112.

In the varying height embodiments, the heights used can be pre-programmed heights or can be set using feedback signals, for instance which are indicative of the depth of the molten metal 112 within the furnace 110.

The invention claimed is:

1. A method of stirring a molten metal, the method including:

stirring at a first location using an electromagnetic stirrer unit that is moveably mounted on a stirrer support carriage;

moving the stirrer unit from the first location to a second location; and stirring at the second location using the stirrer unit, the second location being different from the first location; and wherein:

during movement between the first location and the second location, the stirrer unit is positioned at a first lateral position relative to the stirrer support carriage; and during stirring at the first location and the second location, the stirrer unit is positioned at a second lateral position relative to the stirrer support carriage;

while in the second lateral position, the stirrer unit is further from a longitudinal axis of the stirrer support carriage in a lateral direction than while the stirrer unit is in the first lateral position.

2. A method according to claim 1, where:

during movement of the stirrer unit from the first location to the second location, the stirrer unit is in the first lateral position and does not provide stirring when in the first lateral position; and the stirrer unit provides stirring when in the second lateral position.

3. A method according to claim 1, where:

the stirrer support carriage includes a stirrer support component; and when the stirrer support carriage is at the first location, the stirrer support carriage is aligned with a first stirrer support element; and when the stirrer support carriage is at the second location, the stirrer support component is aligned with a second stirrer support element.

4. A method according to claim 3, where:

during the transition from the first lateral position to the second lateral position, at least a part of the weight of the stirrer unit is transferred from the stirrer support carriage to the first or second stirrer support elements; and/or during the transition from the second lateral position to the first lateral position, all of the weight of the stirrer unit is removed from the first or second stirrer support elements.

5. A method according to claim 1, where:

during the movement from the first location to the second location, the stirrer unit is at a first vertical position; and during the stirring at the first or second locations the stirrer unit is at a second vertical position, that is spaced from the first vertical position in a horizontal plane.

6. A method according to claim 1, where:

while stirring at the first location, the stirrer unit has a different vertical plane position than while stirring at the second location.

7. A method according to claim 1, further comprising:

stirring at the first location at a first time;

stirring at the second location at a second time, stirring at a third location at a third time; and stirring at the first location again at a fourth time.

8. A method according to claim 1, where:

the stirrer unit is at a first rotational orientation while stirring at the first location;

the stirrer unit is at a second rotational orientation while stirring at the second location;

the first rotational orientation and second rotational orientation differ from one another by 90°+/−5° and/or by 180°+/−5°.

9. A method according to claim 8, further comprising rotating the stirrer unit from the first rotational orientation to the second rotational orientation at the second location.

10. A method according to claim 8, further comprising rotating the stirrer unit between the first rotational orientation and the second rotational orientation at one or more intermediate locations between the first and second location.

11. A method of stirring, the method including:

stirring molten metal at a first location using an electromagnetic stirrer unit that is moveably mounted on a stirrer support carriage;

moving, via the stirrer support carriage, the stirrer unit from the first location to a second location; and stirring molten metal at the second location using the stirrer unit;

where, while stirring the molten metal and the first and second location, at least a portion of the stirrer unit is positioned above a portion of the molten metal; and where:

the stirrer unit is positioned in a transit position during movement of the stirrer unit from the first location to the second location;

the stirrer unit is positioned in a use position while stirring molten metal at the first and second locations; and while in the use position the stirrer unit is spaced further from a longitudinal axis of the stirrer support carriage in both a vertical and horizontal direction than while in the transit position.

12. The method of claim 11, further comprising:

after stirring molten metal at the second location:

moving the stirrer unit relative to the stirrer support carriage along a first axis;

moving the stirrer unit relative to the stirrer support carriage along a second axis to the transit position; and moving the stirrer unit and the stirrer support carriage to the first location or a third location.

13. Apparatus for stirring a molten metal, the apparatus including:

an electromagnetic stirrer unit;

a stirrer support carriage which provides a moveable mounting for the stirrer unit and is configured to move the stirrer unit to a number of locations at which stirring is to be provided;

wherein, the stirrer support carriage is configured to move the stirring unit between a first location and a second location selected from amongst the number of locations, the second location being different from the first location; and the stirrer unit is in a transit position during movement between the first location and the second location and the stirrer unit is in a use position at the first location and at the second location during stirring;

while in the use position the stirrer unit is spaced further from a longitudinal axis of the stirrer support carriage in both a vertical and horizontal direction than while in the transit position.

14. Apparatus according to claim 13, where the stirrer unit does not provide stirring when in the transit position; and the stirrer unit is not in the use position during movement of the stirrer support carriage.

15. Apparatus according to claim 13 in which the apparatus includes one or more stirrer support elements provided at the first location and second location.

16. Apparatus according to claim 15, where the support element(s) are rail(s) or the support elements are wheels.

17. Apparatus according to claim 13 in which the stirrer support carriage includes one or more support components for the stirrer unit, the one or more support components allowing relative movement between the stirrer unit and the stirrer support carriage, the relative movement being made by the stirrer unit with the stirrer support carriage stationary during the relative movement.

18. Apparatus according to claim 13, where the stirrer unit is rotatable relative to the stirrer support carriage by at least 90°.

* * * * *